US006173956B1

(12) United States Patent
O'Neal

(10) Patent No.: US 6,173,956 B1
(45) **Date of Patent: *Jan. 16, 2001**

(54) PROJECTILE BACKSTOP ASSEMBLY

(75) Inventor: Kerry Lynn O'Neal, Temecula, CA (US)

(73) Assignee: O.M.F. Inc., Temecula, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/721,806

(22) Filed: Sep. 27, 1996

(51) Int. Cl.[7] ..... F41J 1/12
(52) U.S. Cl. ..... 273/410
(58) Field of Search ..... 273/410, 422–429; 89/36.02

(56) References Cited

U.S. PATENT DOCUMENTS

| | | | | |
|---|---|---|---|---|
| D. 329,680 | | 9/1992 | Burn . | |
| 941,642 | | 11/1909 | Maxim . | |
| 2,743,106 | | 4/1956 | Schels . | |
| 4,294,452 | | 10/1981 | Schlotter et al. . | |
| 4,458,901 | | 7/1984 | Wojcinski . | |
| 4,683,688 | | 8/1987 | Wojcinski . | |
| 4,728,109 | | 3/1988 | Simonetti | 273/410 |
| 4,786,059 | * | 11/1988 | Barini | 273/410 |
| 4,787,289 | | 11/1988 | Duer . | |
| 4,817,960 | | 4/1989 | Wojcinski . | |
| 4,819,946 | | 4/1989 | Kahler . | |
| 4,846,043 | | 7/1989 | Langsam . | |
| 4,856,791 | | 8/1989 | McQuade . | |
| 4,919,437 | * | 4/1990 | Salabe et al. | 273/410 |
| 5,040,802 | | 8/1991 | Wojcinski et al. . | |
| 5,070,763 | | 12/1991 | Coburn | 89/36.02 |
| 5,113,700 | | 5/1992 | Coburn . | |
| 5,121,671 | | 6/1992 | Coburn . | |
| 5,171,020 | | 12/1992 | Wojcinski . | |
| 5,340,117 | | 8/1994 | Wojcinski | 273/410 |
| 5,435,571 | | 7/1995 | Wojcinski et al. | 273/410 |
| 5,441,280 | * | 8/1995 | Copius | 273/410 |
| 5,486,008 | | 1/1996 | Coburn . | |
| 5,607,163 | | 3/1997 | Nesler . | |

FOREIGN PATENT DOCUMENTS

| | | | | |
|---|---|---|---|---|
| 31 31 228 | | 3/1983 | (DE) . | |
| 32 12 781 | | 10/1983 | (DE) . | |
| 39 00 864 | | 7/1990 | (DE) . | |
| 40 22 327 | | 1/1992 | (DE) . | |
| 0 227 612 | | 7/1987 | (EP) . | |
| 399960 | * | 11/1990 | (EP) | 273/410 |

* cited by examiner

*Primary Examiner*—Mark S. Graham
(74) *Attorney, Agent, or Firm*—Brown, Martin, Haller & McClain, LLP

(57) ABSTRACT

A backstop assembly for receiving projectiles, such as bullets. The assembly includes a plate inclined relative to the floor. The plate is covered with loose resilient particles such as rubber, but the rubber is not contained within another medium, nor is it enclosed within a box. A bullet entering the loose particles does not fragment because it is so much harder than the particles. Because the particles move out of the way of the bullet, rather than receive it, the bullets may be separated from the particles, and no lead dust is created by a fragmenting bullet.

19 Claims, 3 Drawing Sheets

PROJECTILE BACKSTOP ASSEMBLY

BACKGROUND OF THE INVENTION

1. Field of the Invention

This invention generally relates to range safety devices and more specifically to a projectile backstop assembly using uncontained loose resilient particles, such as rubber.

2. Description of the Related Art

A number of backstop assemblies for slowing down projectiles, such as bullets or arrows, are known. Some contain granulated material. A typical container for such granulated material is a box-shape container with a self-healing medium dispersed across the side of entry of the projectile. For example, U.S. Pat. Nos. 5,171,020, 5,340,117, and 5,435,571, all to either Wojcinski or Wojcinski, et al. disclose box-shaped containers covered with a self-healing medium, such as rubber or sheets of polymer material with the required elasticity for self-healing.

The projectile enters the container through the self-healing medium but it is the granulate matter located within the container that largely slows down and captures the projectiles after they have entered the container. A disadvantage of the Wojcinski-disclosed backstop assembly is the cost of elements, such as the box-shaped container and the self-healing medium which provide little of the desired functionality of slowing down a projectile. Clearly, it would be economically advantageous to slow down projectiles without the need for such containment means, and particularly for disposing of the requirements of a box-shaped container or a medium covering the opening of such a box.

A further disadvantage of the above-disclosed systems is the need to use flowable granulant materials arranged so that the granulates are periodically moved downward through slopped walls in the bottom of the box that act like a hopper to remove them from the container. To flow the granulates a mechanical agitator or vibrating system is employed. Additionally, to reduce binding or fusing of the material, caused by factors such as the combined weight of the granulants on ones disposed below water is added to the container through a complicated pump system. The requirement of such systems as motorized vibrating means or pump activated water injecting means is very expensive. Thus, it would be an advancement of the art to provide projectile slowing down and capturing assemblies that do not require such machinery.

Other backstop assemblies requiring containers are disclosed by Wojcinski. One containerized backstop assembly is disclosed by Wojcinski in U.S. Pat. No. 4,683,688. The assembly is part of a containerized shooting range and it consists of two rows of louvered panels of hard rubber material. The louvered panels are generally contained within an integral box-shaped container and further within the walls of the shooting range container itself. Another projectile backstop assembly disclosed by Wojcinski in U.S. Pat. No. 4,817,960 includes a container filled with a liquid for decelerating a projectile and elongated sheet of materials sealing the inlet opening. Two other backstop assembles disclosed by Wojcinski in U.S. Pat. Nos. 4,458,901 and 5,040,802 each include a container housing a series of lamella within a frame. A disadvantage of the lamellas is the expense of creating the complex geometry and the need to replace the lamellas when those become damaged by a projectile.

Further contained systems for slowing down and catching projectiles such as bullets are disclosed in U.S. Pat. No. 4,819,946 to Kahler, U.S. Pat. No. 5,486,008 to Coburn, and U.S. Pat. No. 2,743,106 to Schels. The Kahler-disclosed device includes a box with a plurality of vertically oriented resilient panels, aligned with an opening of the box. The Coburn-disclosed device includes a deceleration chamber that relies on complicated geometry and liquid lubricants to slow down a bullet. The Schels-disclosed device provides a receptacle for catching low velocity, low weight projectiles from toy guns including a felt or fibrous fabric to cushion the impact of pellets. Each of the above-described projectile backstop assembles has a disadvantage of requiring a container in parts of complex geometry which must be periodically replaced.

U.S. Pat. No. 4,856,791 to McQuade describes a protective mat assembly that employs a sheet of elastomeric material and a cellular foam substrate mounted to a rigid panel. Projectiles which strike the assembly impact against the plate and projectile fragmentation is contained within the assembly. Although the McQuade-disclosed device does not require a box-shaped container, it has the disadvantage that it allows the projectile to fragment. When a projectile, such as a bullet fragments, it disperses its constituents. In the case of bullet, this means that lead is dissipated into lead dust which is a recognized environmental hazard. Shooting ranges that have backstop assemblies that allow fragmentation of the bullet must hire hazard treatment personnel to periodically remove the lead dust. This is very expensive. Thus it would be a clear advancement in the art to provide a low-cost backstop assembly which did not allow a projectile, such as a bullet to fragment.

It is known to layer strips or plates, one behind the other. One such arrangement is described in German patent publication DE3900-864 A1. The individual strips are inclined to define direction and may be turned over and slid mechanically to alter their angle to the firing direction and reversed over time. German patent publication DE4022-327 A1 shows a similar arrangement but the strips appear to be normal to the firing direction. In either case, the mats or strips must be periodically replaced and are expensive to manufacture and replace.

Clearly there is a need in the art for a low-cost backstop assembly that introduces no lead dust and requires no expensive lubricating or agitating equipment. Further, it would be advantageous to provide such a low-cost backstop assembly not requiring containing means or a projectile receiving medium separate from a medium used to slow and capture a projectile.

SUMMARY OF THE INVENTION

To overcome the disadvantages of the prior art described above, and in view of disadvantages that will become more evident in view of the detailed description below, a backstop assembly for receiving a projectile shot by a shooting instrument, spaced a distance from a shooting-area floor is disclosed. The backstop assembly comprises a plate or substantially planar member that is inclined at a predetermined non-normal angle to the shooting-area floor. Loose resilient particles are distributed over the top face of the inclined planar member and accumulated to a predetermined height. The loose resilient particles receive, slow-down, and capture fired projectiles without the need for a separate enclosing container or a separate medium covering the loose resilient particles.

This invention provides the advantage of a simple, low-cost device for effectively slowing down and capturing projectiles, such as bullets. The resilient particles allow such a bullet to be captured without striking any objects harder than the bullet itself. The bullet is not fragmented and the metal portion remains whole. Thus, another advantage of this invention is that lead dust does not contaminate the environment. A further advantage of this invention is that the bullets may be mined periodically for the value of its metal portion. For example, copper is often used for its desirable characteristics and it has high recycling value.

In one preferred embodiment, the inclined plate is inclined on a support structure such as a steel channel frame structure. In this embodiment, the inclined plate is preferably composed of steel. The height of the rubber may be selected for the caliber of projectile bullets being fired. The resilient particles preferably have some elastomeric properties such as rubber. The inventors have discovered that pure rubber such as rubber retained by cutting automotive tires, such as truck tires, offer particular advantages. Particular advantages may be realized if fibers such as nylon or steel are removed from the rubber before it is used in the backstop assembly. In this way, there is no danger of igniting such fibers or causing inadvertent fragmentation of the bullet.

Another alternative of embodying the invention is to provide a concrete inclined plate disposed on a dirt berm or hill and then covered with the loose resilient particles.

The foregoing, together with other features and advantages of the present invention, will become more apparent and be better understood in referring to the following specification, claims and accompanying drawings.

BRIEF DESCRIPTION OF THE DRAWINGS

For more complete understanding of the present invention, reference is now made to the following detailed description of the embodiments illustrated in the accompanying drawings in which identical numbers and various views represent the same or similar elements, and wherein.

DESCRIPTION OF THE PREFERRED EMBODIMENTS

The following is a detailed description of the preferred embodiments, wherein reference is made to the accompanying drawings in which is shown specific embodiments for practicing this invention. Nevertheless, other embodiments may be utilized and structural changes may be made without departing from the scope of the present invention.

Figure 1:
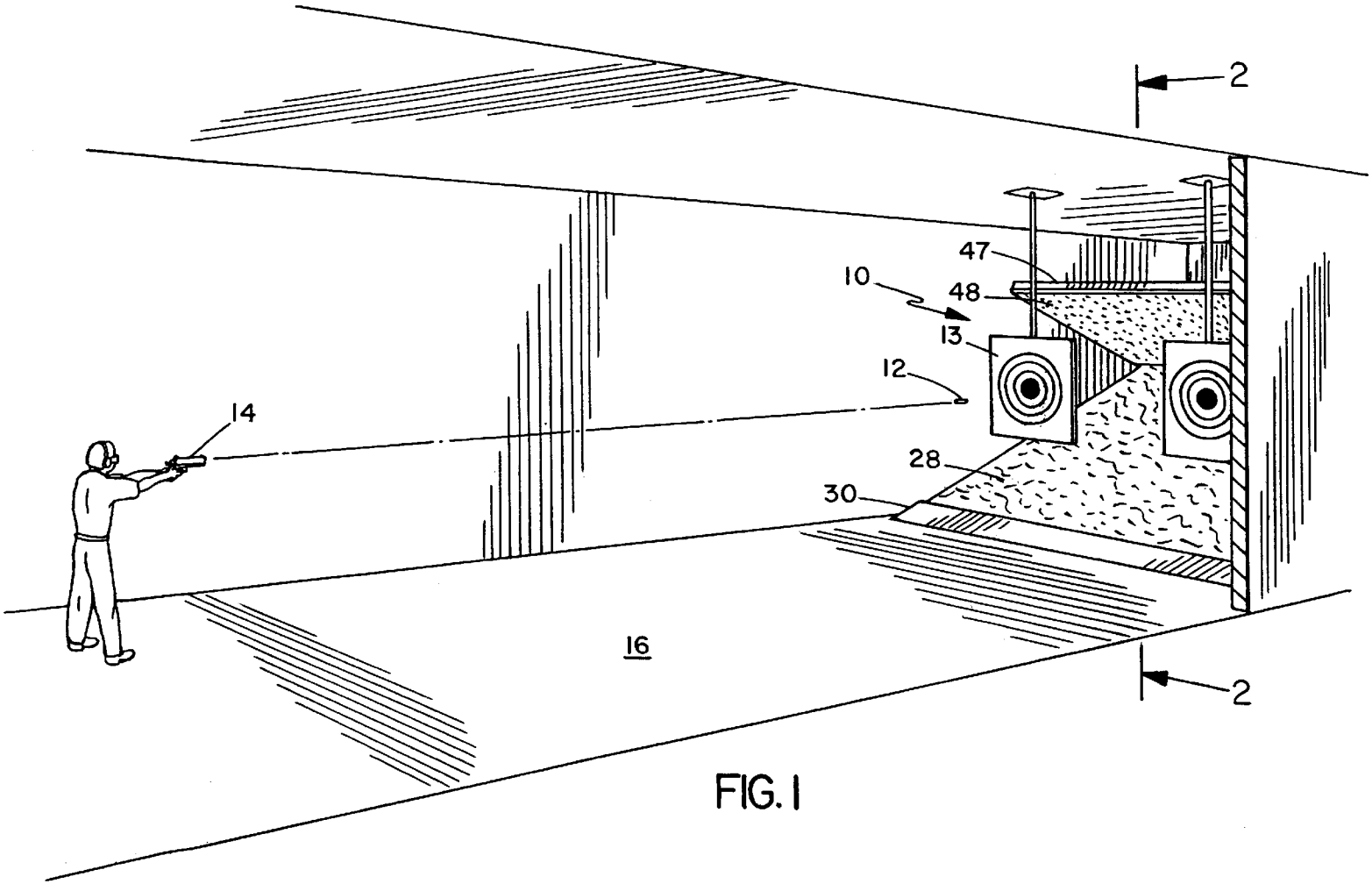
FIG. 1 is a perspective view of an indoor-type shooting range in which the backstop assembly of this invention is particularly useful, and an embodiment of which is shown.

FIG. 1 shows an exemplary indoor-type sports shooting range in which the present invention of backstop assembly 10 is useful. The exemplary shooting range is shown without its typical safety devices, such as separate shooting stalls for the sake of simplicity. For purposes of this example, the shooting range is shown in use with a gun 14; however, the backstop assembly 10 is also useful with projectiles other than bullets 12. For example, it is also useful with arrows (not shown) released from a bow (not shown). The invention is particularly advantageous for use with bullet projectiles because loose resilient particles 28 absorb the impact of the projectile 12 after it passes through target 13 without allowing it to impact a hard surface. Thus, since most bullets contain lead, this prevents hazardous lead dust from being accumulated in the shooting range.

Lead dust is a dangerous hazard associated with shooting ranges, because it causes lead fumes that may be breathed by humans in the area. Moreover, the lead dust is hazardous material and must be periodically removed by specially contracted personnel. Such hazard treatment personnel are very expensive and it is possible that government regulations may soon require means to keep lead dust below a certain level. However, the present invention offers the advantage of eliminating lead dust, or at least minimizing it because a bullet is not allowed to contact a hard surface until it has greatly slowed down or come to rest. It will only be through a rare situation such as an extreme aiming error on the part of the shooter that a bullet would ever strike a hard surface in a range employing backstop assembly 10.

Since the bullet 12 does not fragment, it may be mined for its material content. For example most bullets have a metal portion that surrounds lead within. Often copper is chosen for this metal because of its desirable properties. Copper is an extremely valuable metal and this invention provides the advantage of allowing the bullets to be mined periodically and separated from the loose resilient particles 28.

Thus, this invention offers the above-described advantages of being safe to use, due to the loose resilient particles which allow the projectile to pass through without breakup. This means there is no lead or bullet jacket fragmentation. The bullets are captured in whole. Therefore, it is easier to clean the range because there are no metal particles or lead dust to gather. Thus, there is no need for protective clothing or air aspirators. Because the resilient particles are moved out of the way by the projectile until it softly settles down into a bed of soft resilient particles, the resilient particles themselves may be recycled and reused because they are seldom actually penetrated by the projectile. An additional benefit of this design is that because there is minimal lead dust introduced into the environment of a shooting range, the exhaustive air filters of the range's ventilation system last several times longer than in ranges using typical prior art backstop assemblies.

Figures 2, 3:
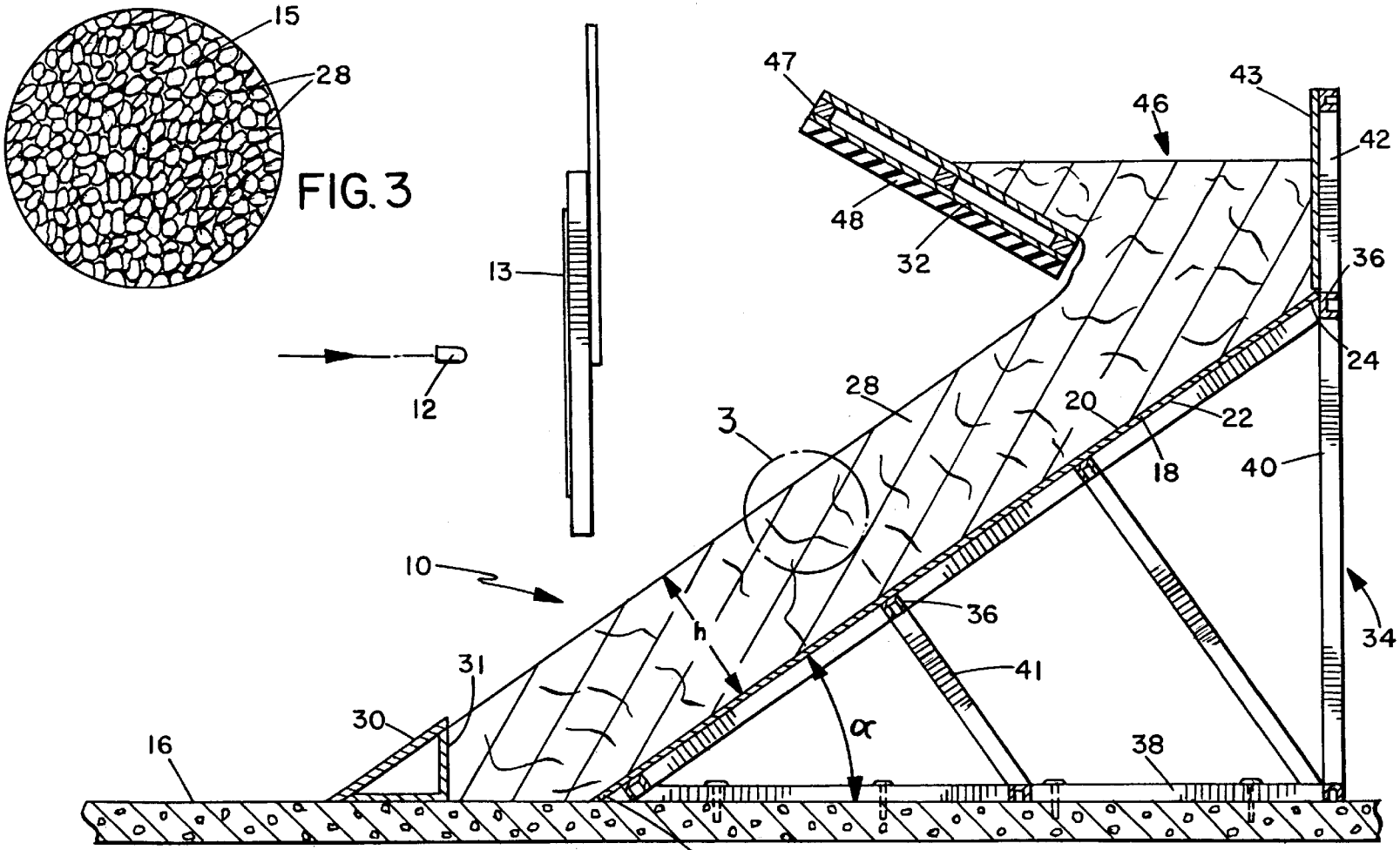
FIG. 2 is an enlarged sectional view of the backstop assembly of this invention shown in FIG. 1 and taken on line 2—2 of FIG. 1.
FIG. 3 is an enlargement of the circled area 3 of FIG. 2 showing the loose resilient particles employed in the backstop assembly of FIGS. 1 and 2.

FIG. 2 shows a sectional view of backstop assembly 10. Referring now to FIGS. 1 and 2, in typical operation, a projectile 12 is fired from shooting instrument 14. Shooting instrument 14 is spaced some distance from shooting floor 16. The projectile passes through target 13 into the resilient particles 28 which are distributed to predetermined depth of height h on a top face 20 of plate or planar member 18. In a shooting range environment, it is preferable that planar member 18 be made of a hard high strength material, such as steel. The height or depth of the resilient particles 28 may be varied according to the caliber of the bullet being fired into target 13. Similarly, the height h is also preferably varied according to the caliber of bullet fired into target 13. For example, for a small caliber bullet which includes any pistol calibers up to 44 mag., it is preferable to use a planar member 18 of about ¼" thickness covered with loose resilient particles 28 piled to about 18" in height.

In a preferred embodiment, planar member 18 is a steel plate inclined at a predetermined non-perpendicular or non-normal angle $\alpha$ shooting area floor 16. Tests by the inventors have shown that the loose resilient particles stay in place without being contained due to frictional forces as long as the predetermined angle α does not exceed 35°. The steel plate 18 is supported at this angle on a steel channel frame 34 comprised of longitudinal members 38, transverse members 36, vertical members 40, and load bearing members 41 disposed normal to plate 18. Plate 18 is supported by the frame at bottom face 22 and near bottom end 26 and top end 24, respectively.

The steel channel frame is merely an exemplary way of supporting planar member 18 at an angle inclined non-normal to shooting area floor 16. Thus, certain thicknesses and widths of steel have been found to be satisfactory in field tests but others might work as well. The thicknesses and widths are merely recommendations provided as examples. One skilled in the art may devise other means or methods for supporting planar member at the non-normal angle α without deviating from the scope or spirit of this invention. However, when using such a frame, it is preferable that steel channel frame 34 be provided with an upper extended channel 42 with a steel plate 43 disposed substantially normal to floor 16. For ¼" steel plates 18 and 43, it is preferable to use a 4" channel steel frame of appropriate length and width in accordance with the length and width of the plates and dimensions of the range. Nevertheless, the length and width dimensions are a design choice not affecting the scope of the invention.

It is known in shooting ranges to provide deflection plates for safety. Thus, in a preferred embodiment of an indoor-type configuration, it is preferable to use a lower steel deflection plate 30 of a size determined by the caliber of the projectile. The steel deflection plate 30 is disposed at a substantially normal angle to shooting floor 16 and spaced some nominal predetermined distance from bottom end 26 of planar member 18. Optional deflection plate 30 provides the advantage that resilient particles 28 may abut plate 30 at face 31 to further minimize the potentiality that a bullet will be fragmented. Although the deflection plate may support loose resilient particles it is not necessary for it to do so.

It is also known to provide an upper deflection plate, such as deflection plate 32, in an indoor-type range. The upper deflection plate 32 is primarily composed of a wood frame 47 and steel liner (not shown) and optionally covered with the non-reflective rubber mat 48 on the side facing the shooter. Conveniently, the resilient particles may be piled high enough to form a virtual hopper 46. Resilient particles 28 are held in place between upper extended vertical member 42, upper deflection plate 32 and top face 20 of planar member 18. This provides an easy way of ensuring that enough resilient particles 28 are in place when replenishing the particles; however, the hopper option may be omitted without negating the utility of this invention.

FIG. 3 shows an enlargement of a group of resilient particles 28. Preferably, resilient particles 28 are rubber. Further, it is preferred that the particles be made out of non-contaminated rubber. The rubber should be uncontaminated so there are no waste or by-products included with the rubber. The inventors have discovered that it is particularly advantageous to obtain the rubber by cutting tires such as truck tires and removing fibrous material such as steel or nylon. Diesel truck tires are particularly advantageous because they are typically made of a harder rubber than automotive tires and are thicker. Nevertheless, the cutting process may be a simple chopping or shredding action and it is not necessary to maintain any uniform size of the resilient particles. This substantially reduces cost because it is not necessary to maintain tight quality control over the dimension of the rubber. Nevertheless, a good choice for the size of the resilient particles is on the order of about ¼" to about 1" in length and about ¼" to 1" in thickness.

Typically, the piled rubber will yield about 50 lbs. per cubic foot of force to surfaces below. For depths over 24", the weight on each particle from particles above starts exceeding 100 lbs and continues to increase as the height h is increased. Excessive weight tends to bind rubber particles near the bottom together. This is undesirable. Thus, it is desirable to maintain enough depth to stop a caliber of the bullet being fired, but on the other hand not so deep that the weight of the resilient particles pressing on the other resilient particles tends to cause binding of the particles together. The inventors have recognized that since 24" or 2' of rubber is sufficient to stop calibers including some rifle calibers that the weight may be maintained so that the bottom particles are not overly pressed together. Some large caliber bullets will require more depth of rubber particles, so an anti-adhesion medium 15 may be applied over the rubber to minimize any binding effect. Calcium carbonate has been found to be a particularly good choice for such a powdered material. Calcium carbonate also has a fire-retardant property which makes it a good choice as well. Nevertheless, since in a preferred environment, there are no fibrous materials such as steel or nylon in the pure rubber and the bullet will not likely contact a hard object such as steel, the probability of fire is very low.

An example of a preferred sizing for the steel for channels of frame 34, for planar member 18, and for height h for pistol calibers has been discussed. Further preferred configurations are discussed now. For medium caliber which includes any rifle calibers up to and including 375 H&H softpoint, it is best to use a 4" channel steel frame with 24" of rubber particles spread over a ¼" thick steel plate 18. For large calibers, including any rifle calibers up to and including 460 Weatherby, it is best to use 4" channel steel for frame 34 and a ⅜" inch steel plate 18. Additional supports may be added to accommodate up to about 36" of rubber particles. For extra large caliber such as that used in military applications, up to and including 50 caliber, it is best to use 6" channel steel with about 48" of rubber particles over a ⅜" steel plate. As in the case of a large caliber, it is best to use additional support under the steel plate to support the added weight. The addition of a powder such as the calcium carbonate is particularly recommended for large caliber and extra large caliber operations.

Figure 4:
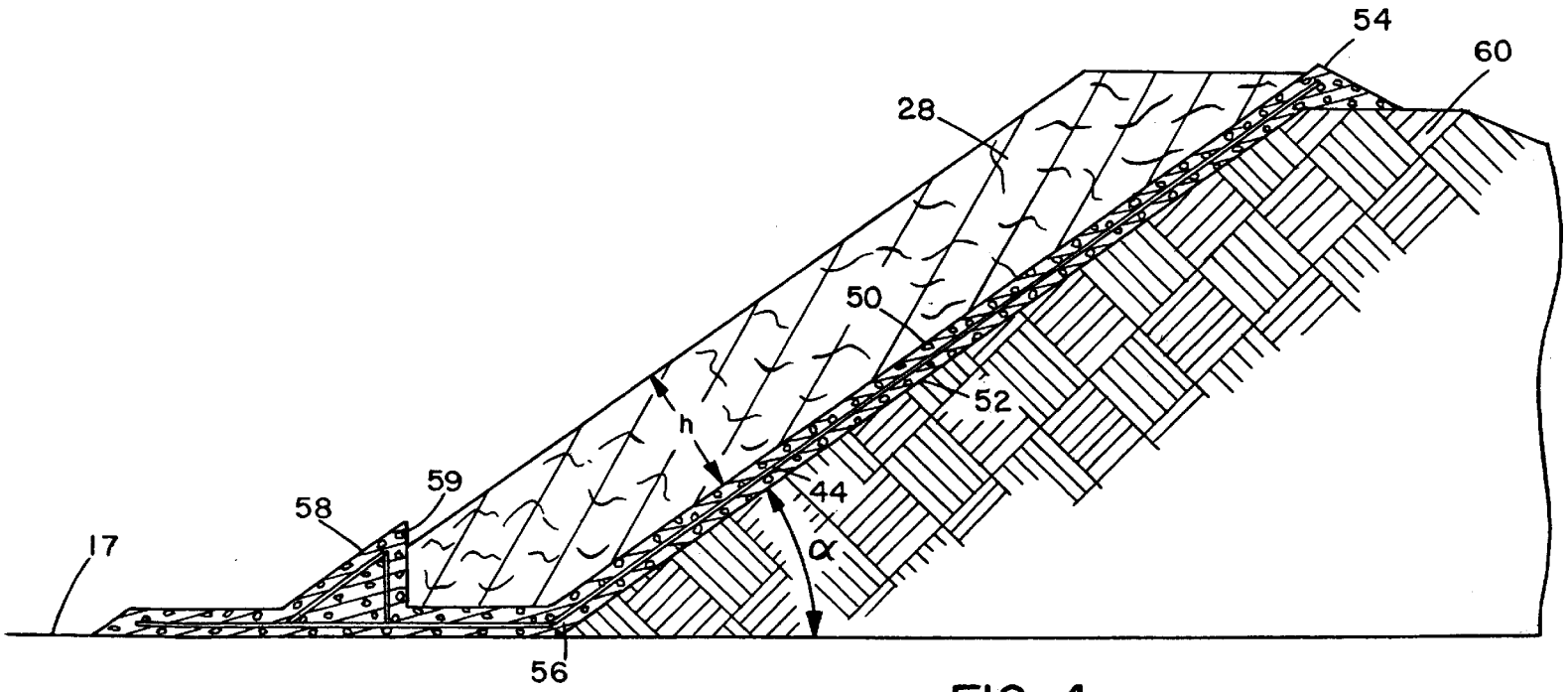
FIG. 4 is a sectional view similar to FIG. 2, but showing an alternative embodiment of the backstop assembly of FIGS. 1 and 2 and adapted for an outdoor-type shoot range.

FIG. 4 shows an alternative embodiment of plate or substantially planar member 44 cast from concrete for use in an outdoor-type shooting range. Planar member 44 serves the identical function of member 44, in the same way, to achieve the same result. Concrete planar member 44 includes top face 50 piled with loose resilient particles 28 to a predetermined height h depending on the caliber of projectile being used. For simplicity, neither a shooting instrument, nor a projectile, nor other articles in a typical outdoor-type shooting range are shown. However, the arrangement of outdoor shooting ranges is well known and the projectile reacts in the same way because resilient particles are the same. Projectile 12 is not shown either.

In such an outdoor shooting range, a concrete deflection plate 58 with a face 59 is useful for the same safety reasons as described above for the steel deflection plate 30 and its face 31. As with the metal indoor-type embodiment described above, the projectile 12 enters the loose resilient particles 28 and simply moves the particles out of the way as it migrates downward toward face 50. The particles 28 are of course piled high enough that the projectile never actually reaches the steel plate during the firing phase. However, a previous fired bullet may eventually reach the plate after many shots have been fired into the plate 44, and this is the same situation that will occur with the preferred embodiment. Once a projectile 12 reaches the face 50, it travels down toward bottom end 56 of planar member 44.

The concrete plate 44 rests with bottom face 52 directly on a dirt berm or earthen slope 60. The plate is inclined at a predetermined angle a just as with the indoor-type environment discussed above. The maximum choice for $\alpha$ should not exceed 35° so the resilient particles will stay in place with merely frictional forces.

The non-containment aspect and the simple geometry of this invention in either embodiment offer many economically advantages. In particular, an enclosing medium does not need to be provided, such as typically provided in the prior art, and there is no need for a box-shaped container. The resilient particles may be sculpted on the concrete plate to provide a wing-type structure on the outside for countering a tendency of the particles to be dispersed, particularly with the use of large caliber bullets. However, this recommended addition of wings is not essential to the utility of this invention. A minimum thickness of the concrete plate 44 should be about 4" with suitable steel reinforcement within. The shooting floor 17 is preferably made of earth, but may also be covered by some substrate such as a concrete slab. The relationship between the shooting area floor 17 and the inclined concrete plate 44 is the same as the relationship between the shooting floor 16 and the steel plate 18.

Recommended depths for the particles in accordance with the caliber of the bullet used are given below. Exemplary thicknesses of concrete are also given. For example, for use with a small caliber bullet including any pistol calibers up to 44 mag., it is best to use a 4" concrete slab on a 35° graded earth and slope or hill with about 18" of rubber particles dispersed over the face 50 of plate 44. For a medium caliber including a rifle caliber up to and including 375 H&H softpoint, it is best to use a 4" concrete plate on a 35° graded slope or hill 60 with 24" of rubber particles spread over face 50 of concrete plate 44. For a large caliber which includes any rifle calibers up to and including 460 Weatherby, it is best to use a 5" concrete slab at the same angle with about 36" of rubber media spread over the concrete. For extra large caliber, up to and including 50 cal., it is best to use a 6" concrete plate with about 48" of rubber particles dispersed over the face of the plate.

Much of the prior art rubber particles used in containers has been reclaimed from conveyor belts which are ground up and include much fiber. The fiber represents a fire risk. In this invention, it is preferred that the rubber be non-contaminated without extraneous material. A good supplier of such non-contaminated rubber is Atlas Rubber Supplier in Los Angeles, Calif. It has been found that by using loose resilient particles of pure rubber, the bullet is not fragmented and retains approximately 99% of its original weight. Thus, there is little or no splatter. Metal from the bullet may now be recycled. The rubber can be used for a much longer period of time than the rubber used for prior-art a container medium that also serves as a point of entry for a projectile.

The amount of precautionary of calcium carbonate that may be added should only be on the order of about 1% of the total volume of the rubber plus the calcium carbonate. The calcium carbonate is probably most useful in situations using large caliber and extra large caliber bullets, and for outdoor configurations where rain may be expected. The calcium may simply be raked in to the rubber. The rubber may be added to the substantially planar member of either embodiment in a variety of ways, including by use of a vacuum system in an indoor-type range, or by the use of a shovel in either the indoor-type or outdoor-type range. In either case, after many uses, the bullets may be harvested readily by separating them from the rubber particles.

A new backstop assembly is described above in which loose resilient particles receive, slow-down, and capture fire projectiles. The loose resilient particles are spread over a substantially planar member having a top face, a bottom face, a top end, and a bottom end. The planar member is inclined at a predetermined, non-normal angle to the shooting area floor. It is not necessary to contain the loose resilient particles, nor is it necessary to provide a box-shaped container, and bullets may be harvested readily with little or no fragmentation. Fire risk is substantially reduced and embodiments can be produced at low cost. Other configurations and arrangements may occur to those skilled in the art without departing from the scope of this invention. Therefore, this invention is not to be limited in any way, except by the claims appended below and their equivalents.

What is claimed is:

1. A backstop assembly for receiving a projectile shot by a shooting instrument spaced a distance from a shooting area floor, comprising:

a horizontally extending, solid shooting area floor;

a substantially planar member having a front face, a rear face, a top end and a bottom end, the planar member being inclined at a predetermined non-normal angle to the shooting area floor with the bottom end engaging the shooting area floor directly with no intervening structure between the bottom end of the planar member and the shooting area floor;

the shooting area floor projecting forwardly from the bottom end of the planar member to provide a solid, stationary horizontal support portion extending directly from the bottom end of the planar member;

a stationary deflection plate projecting upwardly from said support portion at a location spaced forwardly from the bottom end of said planar member;

loose resilient particles for receiving, slowing down, and capturing the projectiles, the loose particles being distributed over the front face of the inclined planar member and being accumulated to a predetermined height to form a generally stationary pile along the length of the planar member which stays in place and resists flowing down the inclined planar member, the pile having a lower end located between said deflection plate and the bottom end of said planar member, said deflection plate comprising means for holding the pile in place;

wherein the assembly is a conveyorless system and has no moving parts, and the loose particles are self-agitating under the influence of the projectiles, thereby requiring no external agitating devices in the conveyorless system;

an upper, substantially flat and planar deflection member located adjacent the top end of the planar member, the deflection member being oriented at a predetermined, non-perpendicular deflection angle projecting forwardly from said planar member, the upper deflection member having a front face forming a deflection plate for deflecting any projectile hitting the plate downward into the pile of particles, and a rear face forming a tapered inlet at the same angle as said deflection member front face for feeding particles onto the pile; and a rubber mat covering the front face of said deflection plate.

2. The assembly as claimed in claim 1, including a vertical surface projecting upwardly from the shooting-area floor at a location spaced rearwardly from the bottom end of the planar member to a location spaced above the top end of the planar member, the top end of the planar member being located adjacent said vertical surface and the planar member being inclined forwardly from said vertical surface.

3. The assembly as claimed in claim 1, including a vertical member extending upwardly from the top end of the planar member and facing said rear face of said upper deflection member to define an inlet hopper between said inclined rear face and vertical member, the resilient particles extending upwardly from the top end of the planar member to fill at least part of said inlet hopper, whereby the pile is kept full of particles at all times.

4. The backstop assembly of claim 1, wherein the loose resilient particles are made of substantially non-contaminated rubber.

5. The backstop assembly of claim 1, wherein the loose resilient particles are made of substantially non-contaminated rubber comprising cut tires which have been purified to remove substantially all contaminating fibrous material including steel and nylon from the rubber.

6. The backstop assembly of claim 5, wherein the loose resilient particles include a variety of different sized and shaped resilient particles.

7. The backstop assembly of claim 6, wherein the largest of the different sized resilient particles is larger than the projectile.

8. The backstop assembly of claim 6, wherein the largest of the different sized resilient particles is about one inch in length and about one-half inch in thickness.

9. The backstop assembly of claim 6, wherein the resilient particles are coated with a powder material.

10. The backstop assembly of claim 9, wherein the powder material is calcium carbonate.

11. The backstop assembly of claim 1, wherein the substantially planer member is made of steel.

12. The backstop assembly of claim 1, wherein the deflection plate is made of steel.

13. The backstop assembly of claim 11, and further comprising a steel support frame fixedly-coupled with the bottom face of the substantially planer member for holding the substantially planer member at the predetermined angle of inclination.

14. The backstop assembly of claim 13, wherein the steel support frame is further fixedly-coupled with the shooting-area floor.

15. The backstop assembly of claim 1, wherein the substantially planer member is made of concrete.

16. The backstop assembly of claim 1, wherein the predetermined non-normal angle is about 35 degrees.

17. The backstop assembly of claim 1, wherein the height of said particles is at least 18".

18. The backstop assembly of claim 17, wherein the height is in the range from 18" to 48".

19. The backstop assembly of claim 1, wherein the height of the pile is at least 24".

* * * * *